United States Patent [19]

Blake

[11] Patent Number: 4,922,565

[45] Date of Patent: May 8, 1990

[54] SEPARABLE MOISTURE PROOF SHEET

[76] Inventor: Bonnae C. Blake, 2781 Collins Rd., Fort Mill, S.C. 29715

[21] Appl. No.: 338,739

[22] Filed: Apr. 14, 1989

Related U.S. Application Data

[63] Continuation-in-part of Ser. No. 134,995, Dec. 18, 1987.

[51] Int. Cl.[5] ..... A47G 9/04

[52] U.S. Cl. ..... 5/484; 5/496; 5/498; 5/502

[58] Field of Search ..... 5/484, 486, 487, 496-502

[56] References Cited

U.S. PATENT DOCUMENTS

| | | | |
|---|---|---|---|
| 2,537,652 | 1/1951 | Churchill | 5/499 |
| 2,779,035 | 12/1957 | McMurry | 5/484 |
| 3,011,182 | 12/1961 | Burks | 5/484 |
| 3,530,487 | 9/1970 | Beer | 5/500 X |
| 3,570,026 | 3/1971 | Allison | 5/496 X |
| 3,761,973 | 10/1973 | Leventhal | 5/484 |
| 4,499,131 | 2/1985 | Knox | 5/484 X |

*Primary Examiner*—Michael F. Trettel
*Attorney, Agent, or Firm*—Clifton T. Hunt

[57] ABSTRACT

A composite bottom sheet or crib sheet comprises a first moisture proof panel overlying the mattress with a surface comfortable for a user and a second panel subjacent the first panel and extending under the mattress during use. Hook and loop fasteners intermesh on top of the mattress to connect the two panels and permit removal of the moisture proof panel when soiled.

3 Claims, 1 Drawing Sheet

SEPARABLE MOISTURE PROOF SHEET

CROSS REFERENCE TO RELATED APPLICATIONS

This application is a continuation-in-part of my copending application Ser. No. 134,995, filed Dec. 18, 1987 for QUICK-CHANGE CRIB SHEET.

FIELD OF THE INVENTION

This invention relates to bed sheets and more particularly to a quick-change moisture proof bottom sheet or crib sheet which is comfortable for the user.

BACKGROUND OF THE INVENTION

The bottom sheets on which incontinent patients lie and the crib sheets on which infants lie are frequently soiled and changed several times a day. The prior art bottom sheets for incontinents and crib sheet for infants are generally not moisture proof but are formed from a soft material such as cotton for the comfort of the user. A separate moisture proof pad or sheet is then required to protect the mattress. See, for example, U.S. Pat. No. 1,621,149 issued Mar. 15, 1927 to Blissitt for MATTRESS AND BED PROTECTOR, U.S. Pat. No. 3,530,487 issued Sept. 22, 1970 to Beer for BEDCLOTHES, and U.S. Pat. No. 3,570,026 issued Mar. 16, 1971 to Allison for BABY BED SHEET WITH REMOVABLE PANEL.

Blissitt discloses (column 1, lines 14-16), but does not illustrate, a bottom sheet of the bed just above his mattress protector 10.

Allison discloses (column 1, line 70 through column 3, line 3), but does not illustrate, a quilted absorbent pad that may be placed over the mattress to protect it before the sheet 16 is attached to its retainer 14.

Beer shows a separate moisture proof pad 14 protecting the mattress beneath a bottom sheet 23.

In each of these pieces of prior art, the moisture proof mattress protector is underneath a pervious bed sheet and becomes soiled when the bed sheet becomes soiled. Consequently, the soiled bed sheet and the soiled mattress protector must both be removed from the bed, must both be washed and must both be replaced on the bed. This is an unpleasant and time consuming task.

Blissitt seeks to relieve the unpleasantness and reduce the time by putting straps on the mattress protector to facilitate its removal and replacement when soiled. But the mattress protector becomes soiled when the sheet is soiled and the soiled sheet and the soiled mattress protector must be removed, washed, and separately replaced.

Beer seeks to relieve the unpleasantness and reduce the time of making up a bed by fastening both the moisture proof mattress protector 14 and the bottom sheet 23 to the mattress or to a mattress cover with zippers or Velcro fasteners and putting an elastic band between the mattress and the top sheet so the user can move about the bed freely without dislodging the bed sheets. But the mattress protector becomes soiled when the sheet is soiled and the soiled sheet 23 and the soiled mattress protector 14 must be removed, washed, and separately replaced.

Allison seeks to relieve the unpleasantness and reduce the time by using a retainer encircling the mattress and a sheet overlying the mattress and connected by zippers to the end edges of the retainer on top of the mattress so the mattress need not be lifted when changing a soiled sheet. But Allison's quilted absorbent pad that may underlie the sheet to protect the mattress will become soiled when the sheet is soiled, and the soiled sheet and the soiled pad must be removed, washed, and separately replaced.

U.S. Pat. No. 4,704,753 issued Nov. 10, 1987 to Lunt for FITTED CRIB OR BED SHEET shows a sheet made of synthetic plastic material having an absorbent top layer laminated to a liquid impermeable backing film to protect the mattress when a crib or bed occupant wets the sheet. Only the soiled sheet need be removed and replaced, which is an improvement over the cited prior art. But, the fitted moisture proof sheet of Lunt is cut and shaped to be tucked around and removed from about the sides and ends of the mattress, which is a time consuming disadvantage overcome by the present invention. This disadvantage is heightened when the crib is equipped with bumper guards, which interfere with the removal and installation of Lunt's fitted sheet.

SUMMARY OF THE INVENTION

It is an object of this invention to provide a bottom sheet or crib sheet which may be quickly and easily removed and replaced, as when soiled, without disturbing any other bedclothes.

It is a more specific object of the invention to provide a bottom sheet or crib sheet of the type described which is a composite sheet comprising a first panel that is moisture proof and covers the top of the mattress with a surface which is comfortable for a user. A second panel subjacent the first panel is folded or fitted under the mattress to hold the composite sheet in place during use. An elastic band extends under the mattress to maintain the tautness and comfort of the sheet.

The two panels are releasably connected along the longitudinal side edges of the first panel on top of the mattress by hook and loop fasteners on the two panels that randomly intermesh on top of the mattress and are readily accessible to quickly and easily connect and disconnect the moisture proof panel without close attention.

The subjacent lower panel of the sheet and the mattress are protected when the moisture proof top panel is soiled. Only the soiled top panel need by changed, washed, and replaced. The protected lower panel needs changing less often than the top panel and the lower panel may be changed when desired.

DETAILED DESCRIPTION OF THE INVENTION

Figure 2:
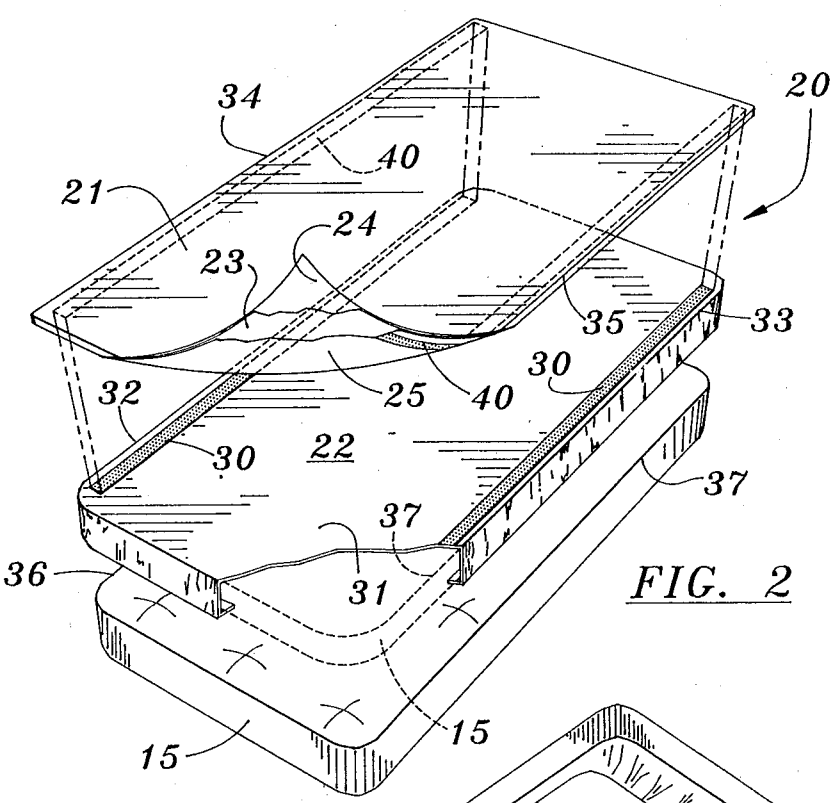
FIG. 2 is an exploded perspective view showing the mattress in solid lines and in phantom lines with the lower panel of the composite sheet fitted to it for use and illustrating the multi-ply construction of the moisture proof panel and the releasable connection of the two panels of the composite sheet.
Figure 3:
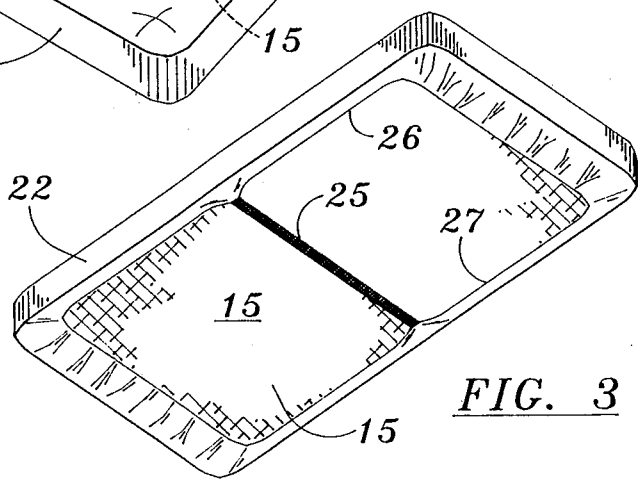
FIG. 3 is a perspective view looking at the bottom of the mattress and illustrating the fitting and anchoring of the lower panel of the composite sheet to the mattress.
Figure 1:
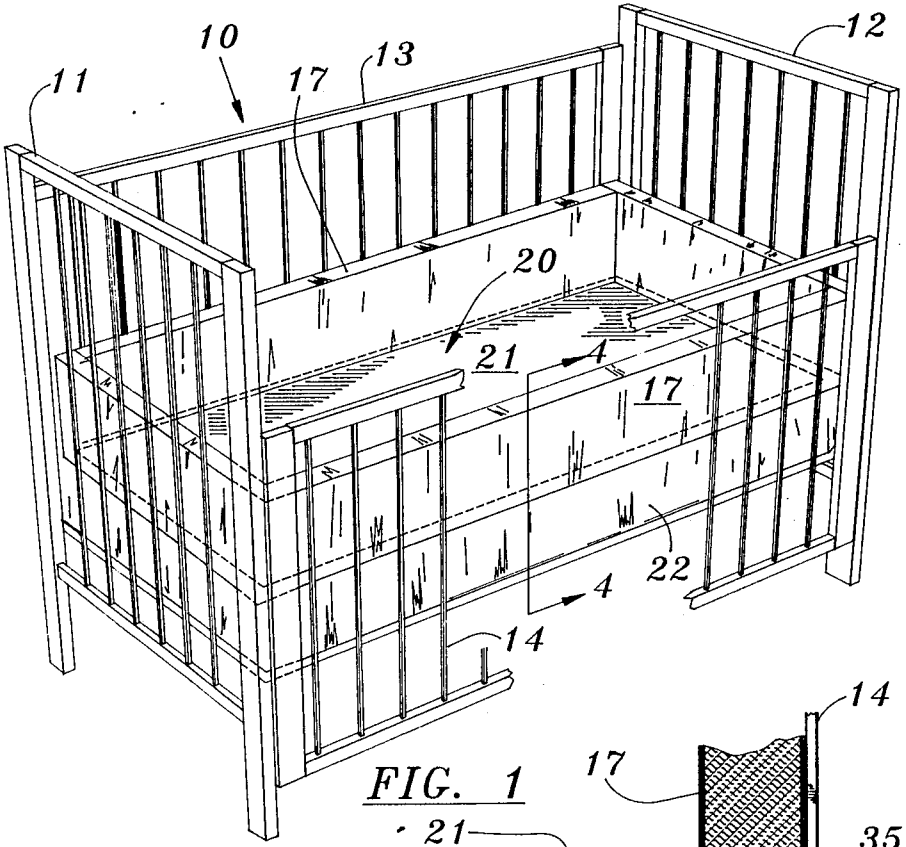
FIG. 1 is a perspective environmental view of a baby crib, with parts broken away, illustrating the difficulty of getting a crib sheet around and under the mattress because of the closely surrounding end walls and side rails and the bumper pads on top of the mattress.

Although the illustrated embodiment shows the sheet as a crib sheet, the composite sheet of this invention is useful on beds of all sizes, and may be made in any desired size.

In the drawings, the numeral 10 broadly indicates a baby's crib including an enclosure defined by end walls 11 and 12 and side rails 13 and 14 closely surrounding a mattress 15 supported by a frame 16. Bumper pads 17 rest on the mattress against the end walls and side rails.

A composite sheet 20 covers the mattress and extends beneath the bumper pads along the side rails 13 and 14. The sheet 20 includes a first panel 21 and a second panel 22 subjacent the first panel. The first or upper panel 21 includes a moisture proof element 23 such as plastic or rubber.

The moisture proof element 23 is sandwiched between a soft fabric surface material 24, such as cotton sheeting, and a subjacent open mesh 25 (FIG. 2). The moisture proof element 23 protects the subjacent panel 22 and the mattress 15, while the soft fabric surface 24 provides comfort for the user.

The lower panel 22 of the composite sheet 20 is preferably formed of a more sturdy material than conventional sheeting and is preferably in the form of a fitted contour sheet adapted to be fitted under the mattress as shown in the drawings. An elastic band 25 extends transversely under the mattress between the mid portion of the inturned longitudinal edges 26, 27 of the lower panel 22. The band 25 tensions the lower panel across the top of the mattress and helps prevent undesirable wrinkling of the composite sheet.

The two panels of the composite sheet 20 are releasably interconnected by washable and reusable hook and loop fasteners. In the illustrated embodiment, strips of hook fasteners 30 are attached to the upper surface 31 of the lower panel 22 in inwardly spaced relation to longitudinal upper edges 32 and 33 of its upper surface 31.

The upper panel 21 is illustrated as being about the same width as the mattress 15, with its longitudinal marginal edges 34 and 35 extending in use in substantially superposed parallel relation to longitudinal upper edges 36 and 37 of the mattress 15.

It is an important feature of the invention that the marginal edges of the upper panel 21 not extend sufficiently beyond the mattress to have to be tucked around the mattress, and preferably overlie the mattress in use.

Strips of loop fasteners 40 are spaced slightly inwardly of the edges 34 and 35 of the upper panel in position to overlie and meshingly engage the hook fasteners 30 to releasably connect the two panels of the composite sheet 20. The loop fasteners 40 are preferably fastened to the upper panel 21 instead of to the lower panel 22 because the upper panel is more frequently washed than the lower panel and the loop fasteners are less likely to become entangled with other items being washed than are the hook fasteners.

Figure 4:
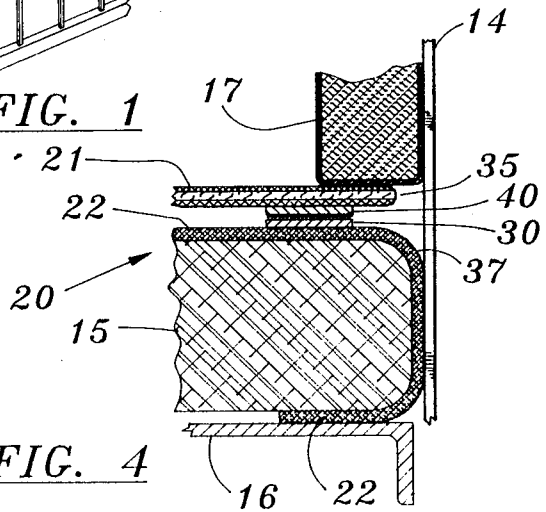
FIG. 4 is a sectional view taken substantially along the line 4—4 in FIG. 1.

As best seen in FIG. 4, the hook and loop fasteners 30 and 40 extend longitudinally of the mattress beneath the longitudinally extending bumper pads 17. This location of the fasteners is easily accessible and the removal and replacement of the upper panel is easily accomplished by simply stretching it across the anchored lower panel and pressing the hook and loop fasteners together beneath the longitudinally extending bumper pads. The placement of the hook and loop fasteners beneath the bumper pads has the additional advantage of locating the fasteners where they are inaccessible or at least hidden from the occupant of a crib.

There is thus provided a composite sheet including a moisture proof panel that protects the mattress and can be easily removed and replaced, as when soiled, without disturbing the mattress or a crib's bumper pads and with a minimum of effort. The less frequently soiled lower panel may be removed and replaced about the mattress in the conventional manner when necessary or desired.

I claim:

1. A separable and moisture proof bottom sheet for covering and protecting a mattress, said sheet comprising an upper panel and a lower panel, said lower panel being configured to cover the top of the mattress and including means to releasably anchor the lower panel of the sheet to the mattress independently of the upper panel, said means comprising parallel edges that extend underneath longitudinal edges of the mattress and an elastic strap attached to and extending between a mid portion of the edges, the upper panel covering the top of the lower panel in use and including a soft fabric upper surface for the comfort of the user and a moisture proof element to protect the lower panel and the mattress, and means for selectively separating the upper panel from the lower panel and connecting the upper panel to the lower panel without disturbing the lower panel, whereby the moisture proof upper panel of the bottom sheet can be separated from the lower panel of the sheet to clean the upper panel when soiled and a clean upper panel can be connected in covering relation to the lower panel to protect the lower panel and the mattress in use.

2. A sheet according to claim 1 wherein said means for selectively separating the upper panel from and connecting the upper panel to the lower panel without disturbing the lower panel comprise components of hook and loop fasteners extending in interlocking relation along the sides of the upper panel and along a line spaced inwardly from the sides of the lower panel in position to be on top of the mattress in use.

3. A sheet according to claim 2 wherein the loop components of the hook and loop fasteners are on the upper panel.

* * * * *